US011804667B2

(12) United States Patent
Henry et al.

(10) Patent No.: US 11,804,667 B2
(45) Date of Patent: Oct. 31, 2023

(54) BOARD-TO-BOARD CONNECTOR ASSEMBLY FOR ADD-IN CARDS

(71) Applicant: TE Connectivity Services GmbH, Schaffhausen (CH)

(72) Inventors: Randall Robert Henry, Lebanon, PA (US); Michael John Phillips, Camp Hill, PA (US); Michael David Herring, Apex, NC (US); Brandon Michael Matthews, McAlisterville, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 136 days.

(21) Appl. No.: 17/383,044

(22) Filed: Jul. 22, 2021

(65) Prior Publication Data

US 2023/0025918 A1 Jan. 26, 2023

(51) Int. Cl.

| | |
|---|---|
| ***H01R 12/72*** | (2011.01) |
| ***H01R 12/70*** | (2011.01) |
| ***H01R 12/73*** | (2011.01) |
| ***H01R 13/629*** | (2006.01) |
| ***H01R 13/502*** | (2006.01) |
| ***H01R 13/627*** | (2006.01) |
| ***H01R 12/78*** | (2011.01) |

(52) U.S. Cl.

CPC ..... *H01R 12/721* (2013.01); *H01R 12/7011* (2013.01); *H01R 12/73* (2013.01); *H01R 12/78* (2013.01); *H01R 13/502* (2013.01); *H01R 13/629* (2013.01); *H01R 13/6272* (2013.01)

(58) Field of Classification Search

CPC .. H01R 12/721; H01R 12/7011; H01R 12/73; H01R 12/78; H01R 13/502; H01R 13/6272; H01R 13/629

See application file for complete search history.

(56) References Cited

U.S. PATENT DOCUMENTS

| | | | | |
|---|---|---|---|---|
| 10,177,476 | B1 * | 1/2019 | Phillips | H01R 12/79 |
| 10,903,594 | B2 | 1/2021 | Herring et al. | |
| 11,545,803 | B1 * | 1/2023 | Wiltraut | H01R 43/16 |
| 2011/0003490 | A1 * | 1/2011 | Chung | H05K 7/20172 439/78 |
| 2017/0040745 | A1 * | 2/2017 | Phillips | H02G 3/22 |
| 2019/0109392 | A1 * | 4/2019 | Phillips | H01R 12/737 |
| 2020/0106201 | A1 * | 4/2020 | Herring | H01R 12/721 |
| 2021/0126392 | A1 * | 4/2021 | Briant | H01R 13/514 |
| 2022/0190513 | A1 * | 6/2022 | Henry | H01R 13/6582 |
| 2022/0190516 | A1 * | 6/2022 | Phillips | H01R 12/7005 |

(Continued)

*Primary Examiner* — Abdullah A Riyami
*Assistant Examiner* — Nelson R. Burgos-Guntin

(57) ABSTRACT

A board-to-board connector assembly includes first and second connector assemblies and a connector interconnect between the first and second connector assemblies. Each connector assembly includes an outer shell and a connector received in a cavity of the outer shell. The connector has a connector body holding contacts in a card slot, which receives a circuit card edge of an add-in card. The outer shell has an outer board guide configured to engage the add-in card and guide mating of the outer shell with the add-in card. The outer shell has a latch configured to latchably engage the add-in card to secure the connector to the add-in card. The connector interposer electrically interconnects the contacts of the connector assemblies to electrically connect the add-in cards.

20 Claims, 5 Drawing Sheets

(56) References Cited

U.S. PATENT DOCUMENTS

| | | | | |
|---|---|---|---|---|
| 2022/0329009 | A1* | 10/2022 | Stoyanov | H01R 13/04 |
| 2022/0336976 | A1* | 10/2022 | Henry | H01R 12/716 |
| 2022/0337001 | A1* | 10/2022 | Hetrick | H01R 13/6275 |
| 2022/0360001 | A1* | 11/2022 | Henry | H01R 12/721 |
| 2022/0384980 | A1* | 12/2022 | Shettar | H01R 13/629 |
| 2022/0384982 | A1* | 12/2022 | Weaver | H01R 13/405 |
| 2023/0025918 | A1* | 1/2023 | Henry | H01R 13/6272 |
| 2023/0034277 | A1* | 2/2023 | Wiltraut | H01R 43/16 |

* cited by examiner

BOARD-TO-BOARD CONNECTOR ASSEMBLY FOR ADD-IN CARDS

BACKGROUND OF THE INVENTION

The subject matter herein relates generally to board-to-board connector assemblies for add-in cards.

Electronic devices, such as computing devices, use communication systems to electrically connect and communicate data between various components of the system. For example, for high power computing devices, such as in hardware accelerators, general purpose GPUs, and the like, host circuit boards are provided with electrical connectors that allow add-in cards to be electrically connected into the system to enhance computing capabilities of the system. The add-in cards are electrically connected to the host circuit board through the electrical connectors on the host circuit board. The add-in cards have electrical components, such as processors, memories, and the like to enhance the capabilities of the system. However, the system is limited by the amount of data that can be communicated between the add-in card and the host circuit board.

Some known systems have been designed to network the add-in cards together to enhance the capabilities of the system even further. For example, secondary electrical connectors are provided on the add-in cards that are networked together through cable assemblies. Such systems are not without disadvantages. For instance, the systems provide hardware on the add-in cards for guidance and mating of plugs of the cable assemblies with the add-in cards. Such hardware occupies valuable board space on the add-in card and/or increases the envelope of the add-in card, which either increases the overall size of the system or reduces the density of the system by reducing the number of add-in cards that are able to fit within a given framework.

A need remains for a communication system that allows electrical interconnection of add-in cards in a reliable and cost effective manner.

BRIEF DESCRIPTION OF THE INVENTION

In one embodiment, a board-to-board connector assembly is provided and includes a first connector assembly having a first outer shell and a first connector received in a first cavity of the first outer shell. The first connector has a first connector body holding first contacts. The first connector body has a first card slot receiving a circuit card edge of a first add-in card. The first contacts are arranged at the first card slot for direct connection with circuit pads of the first add-in card at the circuit card edge of the first add-in card. The first outer shell has a first outer board guide configured to engage the first add-in card and guide mating of the first outer shell with the first add-in card. The first outer shell has a first latch configured to latchably engage the first add-in card to secure the first connector to the first add-in card. The board-to-board connector assembly includes a second connector assembly having a second outer shell and a second connector received in a second cavity of the second outer shell. The second connector has a second connector body holding second contacts. The second connector body has a second card slot receiving a circuit card edge of a second add-in card. The second contacts are arranged at the second card slot for direct connection with circuit pads of the second add-in card at the circuit card edge of the second add-in card. The second outer shell has a second outer board guide configured to engage the second add-in card and guide mating of the second outer shell with the second add-in card.

The second outer shell has a second latch configured to latchably engage the second add-in card to secure the second connector to the second add-in card. The board-to-board connector assembly includes a connector interposer between the first connector and the second connector to electrically interconnect the first contacts and the second contacts. The connector interposer configured to electrically connect the first add-in card and the second add-in card.

In another embodiment, an add-in card assembly for a communication system having a host circuit board is provided. The add-in card assembly includes an add-in card having a primary circuit at a primary circuit card edge configured to be plugged into a primary card edge connector of the host circuit board of the communication system. The add-in card has an electronic component electrically connected to the primary circuit. The add-in card has a secondary circuit electrically connected to the electronic component and routed to a secondary circuit card edge. The add-in card assembly includes a board-to-board connector assembly coupled to the secondary circuit at the secondary circuit card edge. The board-to-board connector assembly has a first connector assembly has a first outer shell and a first connector received in a first cavity of the first outer shell. The first connector has a first connector body holding first contacts. The first connector body has a first card slot receiving the secondary circuit card edge. The first contacts are arranged at the first card slot for direct connection with the secondary circuit of the add-in card. The first outer shell has a first outer board guide configured to engage the add-in card and guide mating of the first outer shell with the add-in card. The first outer shell has a first latch configured to latchably engage the add-in card to secure the first connector to the add-in card.

In a further embodiment, a communication system is provided and includes a host circuit board having a first card edge connector coupled to the host circuit board and a second card edge connector coupled to the host circuit board. The communication system includes a first add-in card coupled to the first card edge connector. The first add-in connector has a first circuit card edge. The communication system includes a second add-in card coupled to the second card edge connector. The second add-in connector has a second circuit card edge. The communication system includes a board-to-board connector assembly coupled to the first add-in card at the first circuit card edge and coupled to the second add-in card at the second circuit card edge to electrically connect the first and second add-in cards. The board-to-board connector assembly includes a first connector assembly having a first outer shell and a first connector received in a first cavity of the first outer shell. The first connector has a first connector body holding first contacts. The first connector body has a first card slot receiving a circuit card edge of a first add-in card. The first contacts are arranged at the first card slot for direct connection with circuit pads of the first add-in card at the circuit card edge of the first add-in card. The first outer shell has a first outer board guide configured to engage the first add-in card and guide mating of the first outer shell with the first add-in card. The first outer shell has a first latch configured to latchably engage the first add-in card to secure the first connector to the first add-in card. The board-to-board connector assembly includes a second connector assembly having a second outer shell and a second connector received in a second cavity of the second outer shell. The second connector has a second connector body holding second contacts. The second connector body has a second card slot receiving a circuit card edge of a second add-in card. The second contacts are arranged at the second card slot for direct connection with circuit pads of the second add-in card at the circuit card edge of the second add-in card. The second outer shell has a second outer board guide configured to engage the second add-in card and guide mating of the second outer shell with the second add-in card. The second outer shell has a second latch configured to latchably engage the second add-in card to secure the second connector to the second add-in card. The board-to-board connector assembly includes a connector interposer between the first connector and the second connector to electrically interconnect the first contacts and the second contacts. The connector interposer configured to electrically connect the first add-in card and the second add-in card.

DETAILED DESCRIPTION OF THE INVENTION

Figure 1:
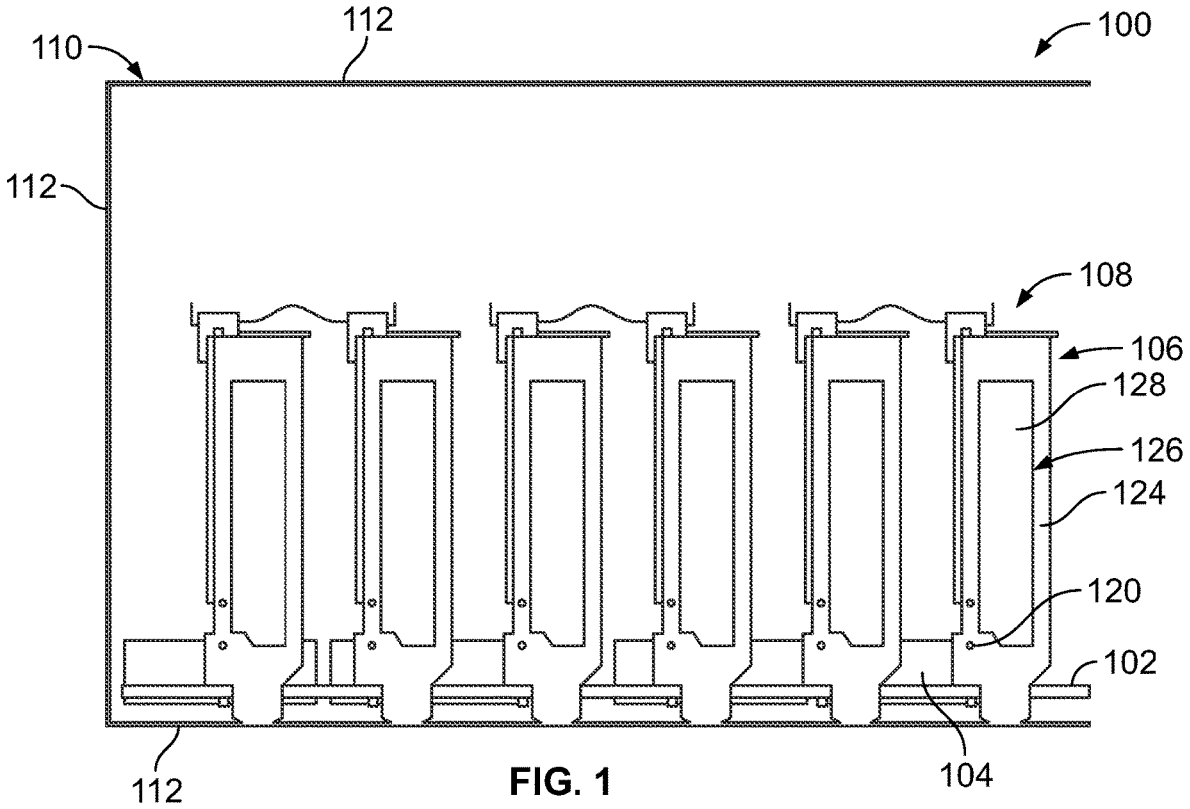
FIG. 1 is a front view of a communication system in accordance with an exemplary embodiment.
Figure 2:
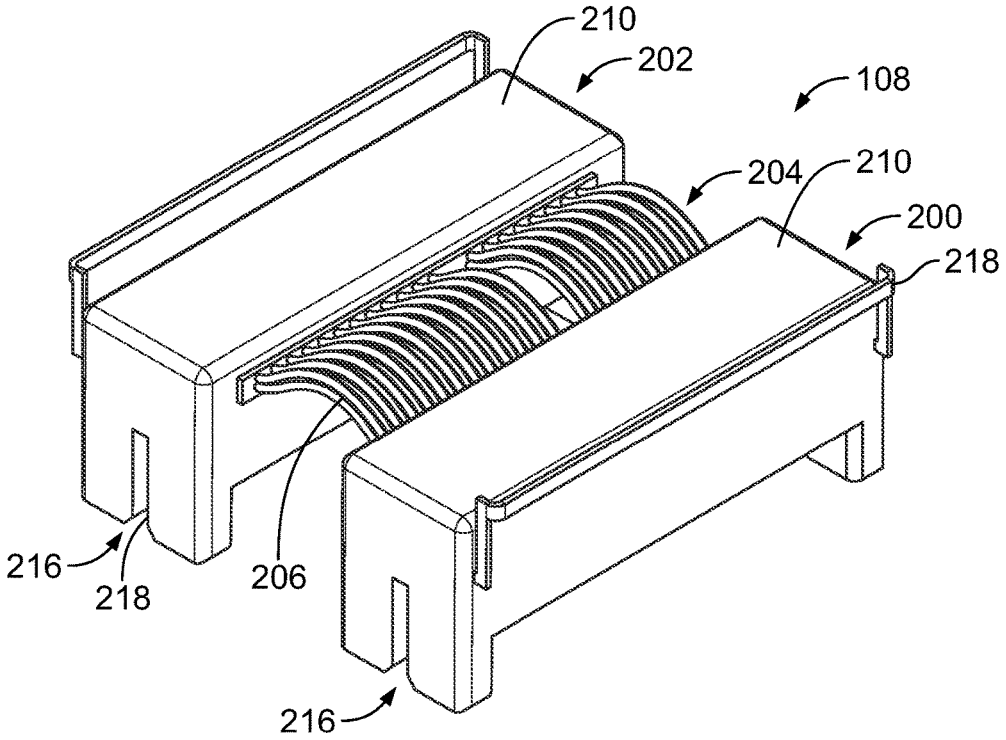
FIG. 2 is a side view of the communication system in accordance with an exemplary embodiment.

FIG. 1 is a front view of a communication system 100 in accordance with an exemplary embodiment. FIG. 2 is a side view of the communication system 100 in accordance with an exemplary embodiment. The communication system 100 may be used in an electronic device or computing device. For example, the communication system 100 may be used for high power computing, such as in a hardware accelerator, a general purpose GPU, and the like. In an exemplary embodiment, the communication system 100 includes a host circuit board 102 having electronics thereon. The host circuit board 102 includes connectors, such as card edge connectors 104 for interfacing with multiple add-in card assemblies 106.

In an exemplary embodiment, the add-in card assemblies 106 include board-to-board connector assemblies 108 to electrically connect various add-in card assemblies 106 to network the add-in card assemblies 106. The board-to-board connector assemblies 108 provide communication paths between the add-in card assemblies 106 separate from the host circuit board 102. The board-to-board connector assemblies 108 enhance processing capabilities of the communication system 100 by networking the add-in card assemblies 106. In an exemplary embodiment, the board-to-board connector assemblies 108 are low profile. Optionally, the board-to-board connector assemblies 108 allow add-in card assemblies 106 to be electrically connected to multiple other add-in card assemblies 106. In an exemplary embodiment, the board-to-board connector assemblies 108 are mounted directly to the add-in cards of the add-in card assemblies 106 to minimize components and interfaces between the components.

In an exemplary embodiment, the communication system 100 includes a chassis 110 holding the host circuit board 102 and the add-in card assemblies 106. The chassis 110 may include panels 112 forming an enclosure. The host circuit board 102 may be coupled to the chassis 110, such as coupled to a bottom panel of the chassis 110. Optionally, the host circuit board 102 may be oriented horizontally at the bottom of the chassis 110. The add-in card assemblies 106 may be located above the host circuit board 102 in various embodiments. For example, the add-in card assemblies 106 may be oriented vertically and stacked adjacent each other along the host circuit board 102.

With reference to FIG. 2, the add-in card assembly 106 includes an add-in card 120 and one or more electronic components 122 mounted to the add-in card 120. The electronic component 122 may be electrically connected to the host circuit board 102 through the card edge connector 104. For example, a primary circuit card edge 130 of the add-in card 120 may be plugged into the card edge connector 104. A primary circuit 132 may electrically connect the electronic component 122 with the primary circuit card edge 130 of the add-in card 120.

The board-to-board connector assembly 108 may be electrically connected to a secondary circuit card edge 134 of the add-in card 120. A secondary circuit 136 may electrically connect the electronic component 122 with the secondary circuit card edge 134 of the add-in card 120.

In an exemplary embodiment, the add-in card assembly 106 includes a front panel 124 mounted to a front of the add-in card 120. The front panel 124 may be coupled to the chassis 110 to present an interface for the add-in card 120 at the chassis 110. For example, the front panel 124 may include a port 126 having an interface connector 128. The interface connector 128 may be a socket connector, a header connector, a receptacle connector or another type of connector for mating with a mating connector, such as a plug connector. An interface circuit 138 may electrically connect the interface connector 128 with the electronic component 122.

In an exemplary embodiment, the primary circuit card edge 130 is provided at a bottom 140 of the add-in card 120 and the secondary circuit card edge 134 is provided at a top 142 of the add-in card 120. Optionally, the add-in card 120 may include multiple secondary circuit card edges 134 at the top 142 for interfacing with multiple board-to-board connector assemblies 108 along the top 142. In an exemplary embodiment, the primary circuit card edge 130 includes a guide slot 144 to guide mating with the card edge connector 104 (shown in phantom in FIG. 2). The add-in card 120 includes contact pads 146 arranged along the primary circuit card edge 130 for mating with the card edge connector 104. The contact pads 146 may be signal contacts, ground contacts, or power contacts. The signal contacts may be high speed signals, low speed signals and the like. The contact pads 146 may be defined by circuits of the add-in card 120, such as circuits of the primary circuit 132.

In an exemplary embodiment, the secondary circuit card edge 134 includes contact pads 150 at the circuit card edge 134. The contact pads 150 may be provided on both sides of the add-in card 120 in various embodiments. In an exemplary embodiment, the secondary circuit card edge 134 includes a guide slot 152 to guide or position the board-to-board connector assembly 108 relative to the secondary circuit card edge 134. Optionally, contact pads 150 may be provided on both sides of the guide slot 152. In an exemplary embodiment, the add-in card 120 includes channels 154 at opposite ends of the secondary circuit card edge 134. The channels 154 define the secondary circuit card edge 134 and separate the secondary circuit card edge 134 from flanking members 156 on opposite ends of the secondary circuit card edge 134. The flanking members 156 may be provided between the various circuit card edges 134. The channels 154 may be formed by removing material of the add-in card 120, such as by using a router or other device to cut or remove material to form the channel 154.

The channel 154 has an inner surface 158 extending along the circuit card edge 134 and an outer surface 160 extending along the flanking member 156. Optionally, the inner surface 158 and/or the outer surface 160 may be generally perpendicular to the top 142. In various embodiments, the inner surface 158 and/or the outer surface 160 at the top 142 may be chamfered to provide a lead-in to the channel 154 to guide the board-to-board connector assembly 108 into the channel 154. In various embodiments, the inner surface 158 and/or the outer surface 160 may be stepped having one or more shoulders 162. The inner surface 158 and/or the outer surface 160 may be used as a guide surface to guide mating of the board-to-board connector assembly 108 with the add-in card 120.

Figure 3:
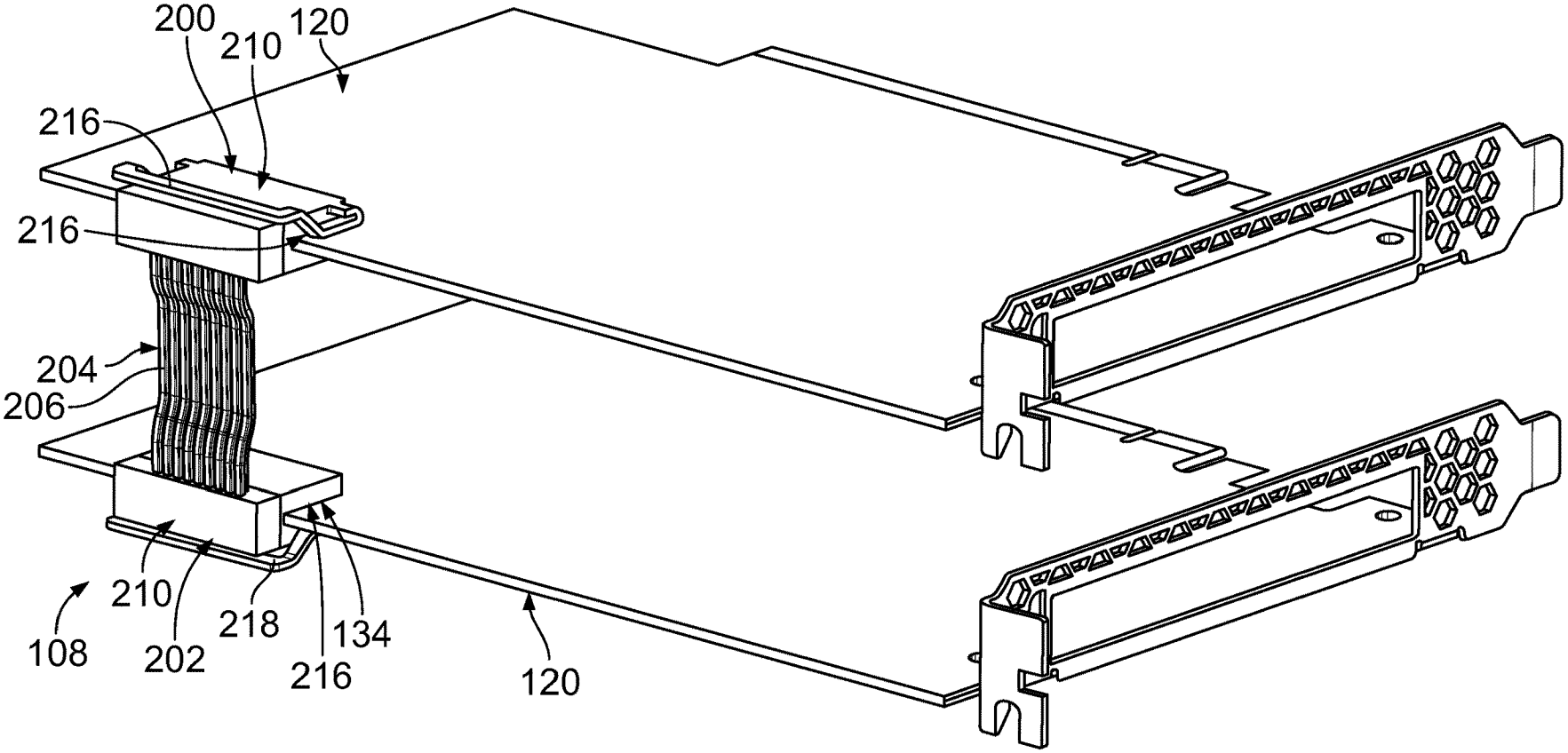
FIG. 3 is a perspective view of the board-to-board connector assembly in accordance with an exemplary embodiment.

FIG. 3 is a perspective view of the board-to-board connector assembly 108 in accordance with an exemplary embodiment. The board-to-board connector assembly 108 includes a first connector assembly 200, a second connector assembly 202 and a connector interposer 204 between the first connector assembly 200 and the second connector assembly 202. Optionally, the second connector assembly 202 may be similar to, or even identical to, the first connector assembly 200, and like components may be identified with like reference numerals with or without the "first" or "second" identifiers, respectively.

In the illustrated embodiment, the connector interposer 204 includes wires 206 between the first and second connector assemblies 200, 202. However, in alternative embodiments, the connector interposer 204 may include another type of interconnect, such as a flexible circuit, a printed circuit board, or another type of interconnect. In the illustrated embodiment, the connector interposer 204 electrically connects the first connector assembly 200 to the second connector assembly 202. In other various embodiments, the connector interposer 204 may electrically connect the first connector assembly 200 to one or more additional connectors and/or may electrically connect the second connector assembly 202 one or more additional connectors.

Figure 5:
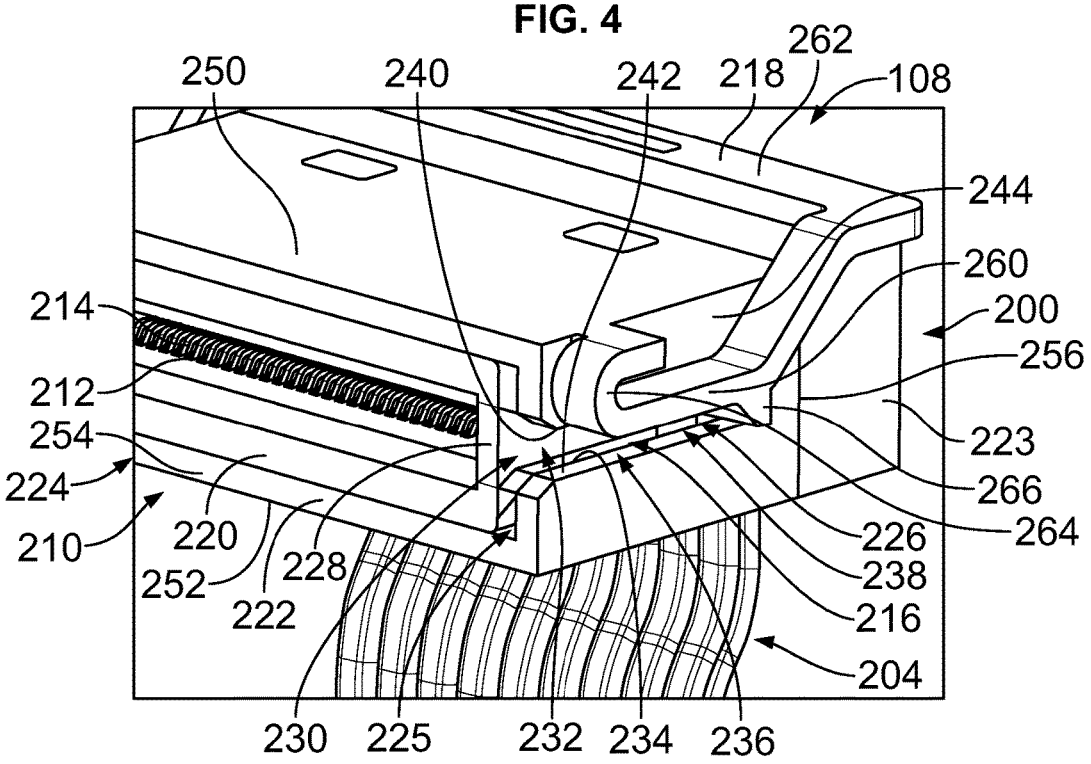
FIG. 5 is a front view of the connector assembly of the board-to-board connector assembly in accordance with an exemplary embodiment.

The connector assembly 200 includes a connector housing 210 holding contacts 212 (shown in FIG. 5). The connector housing 210 has a card slot 214 (shown in FIG. 5) for interfacing with the circuit card edge 134 (shown in FIG. 2) of the add-in card 120 (shown in FIG. 2). The connector housing 210 has a board guide 216 configured to engage the add-in card 120 and guide mating with the add-in card 120. The connector assembly 200 has a latch 218 configured to latchably engage the add-in card 120 to secure the connector assembly 200 to the add-in card 120.

The second connector assembly 202 similarly includes a second connector housing 210 holding second contacts 212 in a second card slot 214 and having a second board guide 216 and a second latch 218. The connector interposer 204 electrically connects the first contacts 212 of the first connector assembly 200 with the second contacts 212 of the second connector assembly 202. The connector interposer 204 extends between the first connector housing 210 of the first connector assembly 200 and the second connector housing 210 of the second connector assembly 202.

Figure 4:
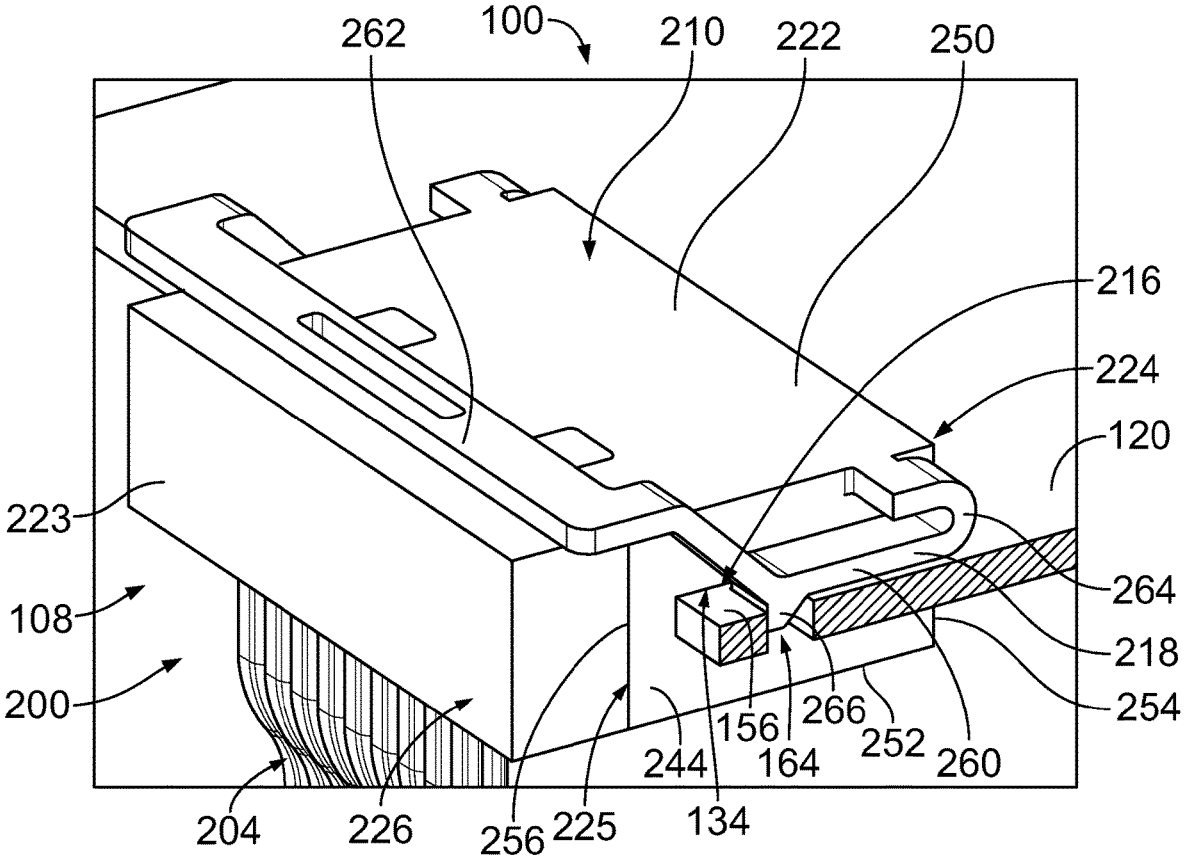
FIG. 4 is a rear view of the connector assembly of the board-to-board connector assembly in accordance with an exemplary embodiment.

FIG. 4 is a rear view of the connector assembly 200 of the board-to-board connector assembly 108 in accordance with an exemplary embodiment. FIG. 5 is a front view of the connector assembly 200 of the board-to-board connector assembly 108 in accordance with an exemplary embodiment.

In an exemplary embodiment, the connector housing 210 of the connector assembly 200 is a multi-piece housing including an inner housing or connector body 220, an outer housing or outer shell 222 holding the connector body 220, and a rear housing 223 received in the outer shell 222 to retain the connector body 220 in the outer shell 222. The connector housing 210 may be provided without the rear housing 223 in alternative embodiments. In alternative embodiments, the connector housing 210 is a single piece housing rather than a multi-piece housing.

The connector body 220 is manufactured from a dielectric material, such as a plastic material. The connector body 220 may be molded, such as being injection molded. The connector body 220 holds the contacts 212 (FIG. 5) and defines the card slot 214 (FIG. 5) that receives the circuit card edge 134 (shown in FIG. 2) of the add-in card 120 (shown in FIG. 2). The connector body 220 extends between a front 224 and a rear 226. The card slot 214 is open at the front 224 to receive the circuit card edge 134. As depicted in FIG. 5, the card slot 214 extends along a longitudinal axis between opposite side walls 228 of the connector body 220. The contacts 212 are arranged along the card slot 214, such as spaced apart longitudinally along the length of the card slot 214. Optionally, the contacts 212 may be arranged both above and below the card slot 214 to engage both sides of the circuit card edge 134.

In an exemplary embodiment, the connector body 220 includes an inner board guide 230 forming a portion of the board guide 216. The inner board guide 230 is defined by a slot or a channel 232 formed in the side walls 228 of the connector body 220 that receives the add-in card 120. The inner board guide 230 may be provided on both sides of the connector body 220. The inner board guide 230 may include a support shelf 234 defining the channel 232 that interfaces with the add-in card 120 to locate the connector body 220 relative to the add-in card 120.

The outer shell 222 is manufactured from a dielectric material, such as a plastic material. The outer shell 222 may be molded, such as being injection molded. In alternative embodiments, the outer shell 222 may be manufactured from a metal material to provide electrical shielding. For example, the outer shell 222 may be a stamped and formed or die cast part. The outer shell 222 may be a plated plastic part. The outer shell 222 receives the connector body 220 in a cavity 225. The connector body 220 may be secured in the outer shell 222, such as using crush ribs, latches, clips, fasteners, and the like. In an exemplary embodiment, the rear housing 223 is used to secure the connector body 220 in the cavity 225. The latch 218 extends from the outer shell 222, such as from an exterior of the outer shell 222 to interface with the add-in card 120.

The outer shell 222 includes an outer board guide 236, which defines at least a portion of the board guide 216. For example, the outer board guide 236 includes a slot or channel 238 formed through the side walls of the outer shell 222. The outer board guide 236 is configured to interface with the add-in card 120 to locate the connector assembly 200 relative to the add-in card 120. The outer board guide 236 may include a shelf, shoulder, or other feature that engages the add-in card 120 to locate the outer shell 222 relative to the add-in card 120. In an exemplary embodiment, outer board guides 236 are provided on both sides of the outer shell 222. The outer board guides 236 are aligned with the inner board guides 230 to together define the board guides 218 and cooperatively engage the add-in card 120 to support the connector assembly 200 on the add-in card 120. The outer board guide 236 aligns the outer shell 222 relative to the add-in card 120 and the inner board guide 230 aligns the connector body 220, and thus the card slot 214 with the add-in card 120. In alternative embodiments, the board guide 216 may be defined by the outer board guide 236 without the inner board guide 230. Rather, the outer shell 222 is used to align and position the connector body 220 relative to the circuit card edge 134 of the add-in card 120.

In the illustrated embodiment, the outer board guide 236 includes a first support shelf 240 and a second support shelf 242 separated from the first support shelf 240 by a gap. The gap defines the channel 238. The channel 238 is aligned with the inner board guide 230. The channels 238 may be provided at both side walls 244 of the outer shell 222. Each channel 238 is configured to receive the add-in card 120, such as the circuit card edge 134 and/or the flanking members 156. The first support shelf 240 is configured to engage a first side of the add-in card 120 and the second support shelf 242 is configured to engage a second side of the add-in card 120. The outer board guide 236 is used to guide the add-in card 120 relative to the card slot 214 of the connector body 220, such as to align the connector body 220, and thus the card slot 214, with the add-in card 120. Optionally, the end of the outer board guide 236 may define a hard stop configured to engage the top edge of the add-in card 120 when fully loaded to position the connector assembly 200 relative to the add-in card 120.

In an exemplary embodiment, the outer shell 222 includes a first end 250 and a second end 252 opposite the first end 250. The outer shell 222 includes a front 254 and a rear 256 opposite the front 254. The front 254 is configured to be coupled to the add-in card 120. The rear housing 223 is coupled to the rear 256 of the outer shell 222. The ends 250, 252 extend between the side walls 244 and extend between the front 254 and the rear 256. The first end 250 may be a top and the second end 252 may be a bottom. In other orientations the first end 250 may be a bottom and the second end 252 may be a top. Other orientations are possible in alternative embodiments. The latch 218 extends from the side walls 244 and extends along the first end 250. In an exemplary embodiment, the connector body 220 is received in the cavity 225 such that the connector interposer 204 extends from the second end 252.

In an exemplary embodiment, the latch 218 includes latch arms 260 extending from the sides of the outer shell 222 and a connecting beam 262 extending between the latch arms 260. The latch arms 260 extend from the outer shell 222 at fixed ends of the latch arms 260. In the illustrated embodiment, the fixed ends are located at the first end 250 of the outer shell 222. The fixed ends may be located at the front 254 and the latch arms 260 may extend generally rearwardly to the connecting beam 262. The latch arms 260 are deflectable at the fixed ends. For example, the latch arms 260 may be pivoted or rotated about the fixed ends as the latch 218 moves between a latched position and an unlatched position. In an exemplary embodiment, the latch arm 260 includes a spring portion 264. The spring arm 264 may be flexed as the latch 218 is moved to the unlatched position. The spring arm 264 returns to the resting position when the latch 218 is released to move the latch 218 to the latched position. Each latch arm 260 includes a latching tab 266 extending from the inside surface of the latch arm 260. The latching tab 266 is configured to be received in a pocket or window in the add-in card 120 to latchably secure the connector assembly 200 to the add-in card 120. The connecting beam 262 extends between the latch arms 260. The connecting beam 262 may be pushed or pulled to unlatch the latch 218. In an exemplary embodiment, a pull tab or other component may be attached to the connecting beam 262 to move the latch 218.

The rear housing 223 is received in the cavity 225 and coupled to the outer shell 222. In an exemplary embodiment, the rear housing 223 is formed in place in the cavity 225 after the connector body 220 is loaded into the cavity 225. For example, the rear housing 223 may be injection molded into the cavity 225. The rear housing 223 may be a hot melt epoxy material formed in place in the rear end of the outer shell 222. The outer shell 222 may include openings or pockets that receive the rear housing 223 to lock the rear housing 223 in the cavity 225. The rear housing 223 may provide strain relief for the connector interposer 204, such as being molded around the wires of the connector interposer 204.

As shown in FIG. 4, the connector housing 210 is mounted directly to the add-in card 120 at the circuit card edge 134. The circuit card edge 134 plugs into the connector assembly 200. The connector assembly 200 is supported directly on the add-in card 120. The board guide 216 guides mating with the add-in card 120 and supports the connector assembly 200 on the add-in card 120. The latch 218 directly engages the add-in card 120 to secure the connector assembly 200 to the add-in card 120. In the latched position, the latch 218 is received in a notch 164 in the add-in card 120 to secure the connector assembly 200 to the add-in card 120.

The board-to-board connector assembly 108 makes an electrical connection to the add-in card 120 across a single electrical interface with the circuit card edge 134 of the add-in card 120. The communication system 100 does not provide a separate connector mounted to the add-in card 120 that the board-to-board connector assembly is mated to. Rather, the board-to-board connector assembly 108 mates directly to the circuit card edge 134 of the add-in card 120. The mating guidance is provided by the interaction between the add-in card 120 and the board guide 216 (for example, the inner board guide 230 and the outer board guide 236). The latching is provided by the latch 218 directly engaging the add-in card 120.

Figure 6:
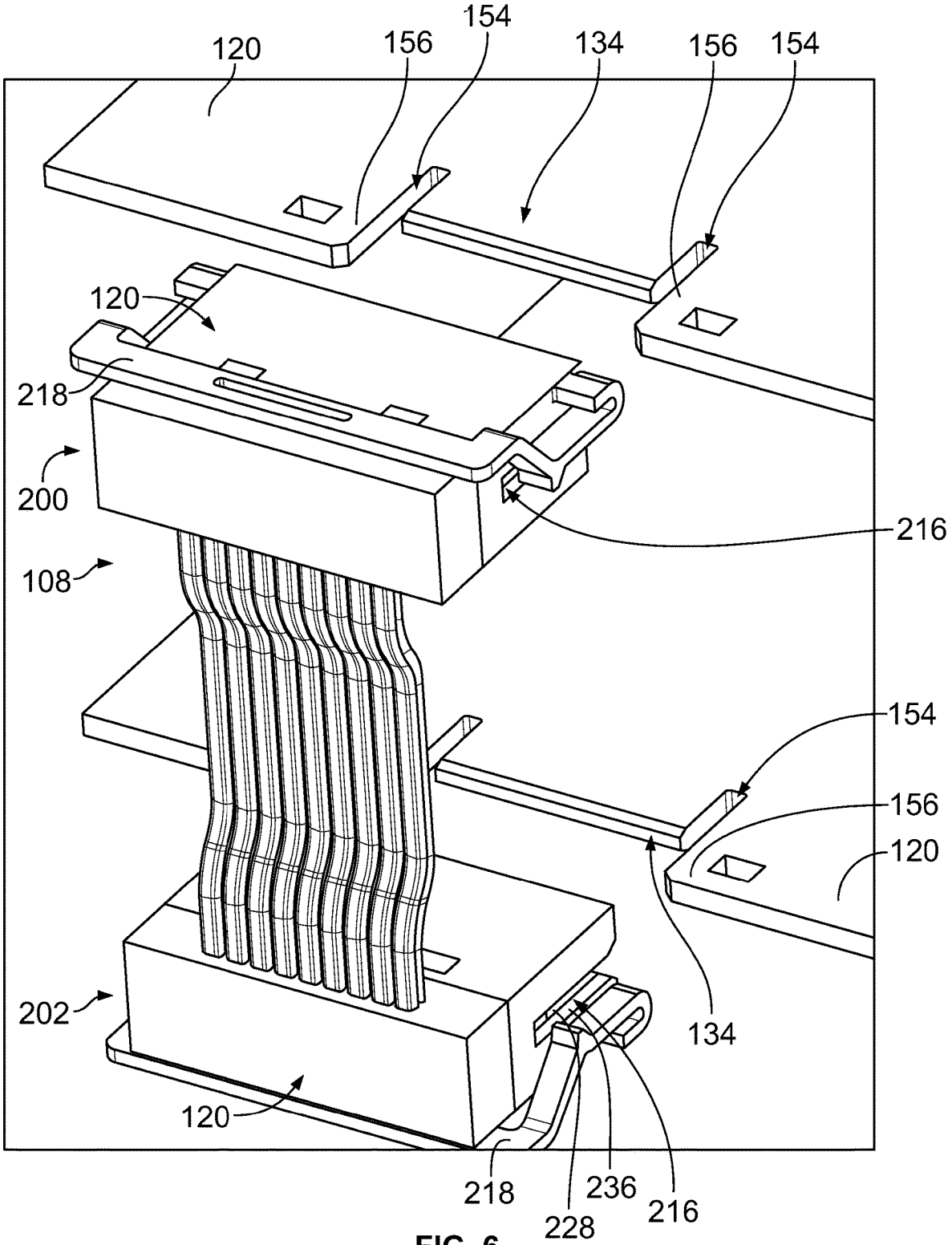
FIG. 6 is a perspective view of the board-to-board connector assembly in accordance with an exemplary embodiment showing the board-to-board connector assembly poised for coupling to first and second add-in cards.

FIG. 6 is a perspective view of the board-to-board connector assembly 108 in accordance with an exemplary embodiment showing the board-to-board connector assembly 108 poised for coupling to the first and second add-in cards 120. The first and second connector assemblies 200, 202 are aligned with the secondary circuit card edges 134 of the add-in cards 120. For example, the connector housing 210 is aligned with the channels 154 on the sides of the corresponding secondary circuit card edge 134.

During assembly, the board guides 216 are mated with the add-in card 120 to align the card slots 214 of the connector assemblies 200, 202 with the secondary circuit card edges 134 of the add-in cards 120. In an exemplary embodiment, the inner and outer board guides 228, 236 receive the flanking members 156. The support shelves interface with the upper and lower surfaces of the add-in cards 120 to position the connector assemblies 200, 202 relative to the add-in cards 120. As the connector assemblies 200, 202 are plugged onto the secondary circuit card edges 134, the latches 218 interface with the add-in cards 120 to secure the connector assemblies 200, 202 to the add-in cards 120.

Figure 7:
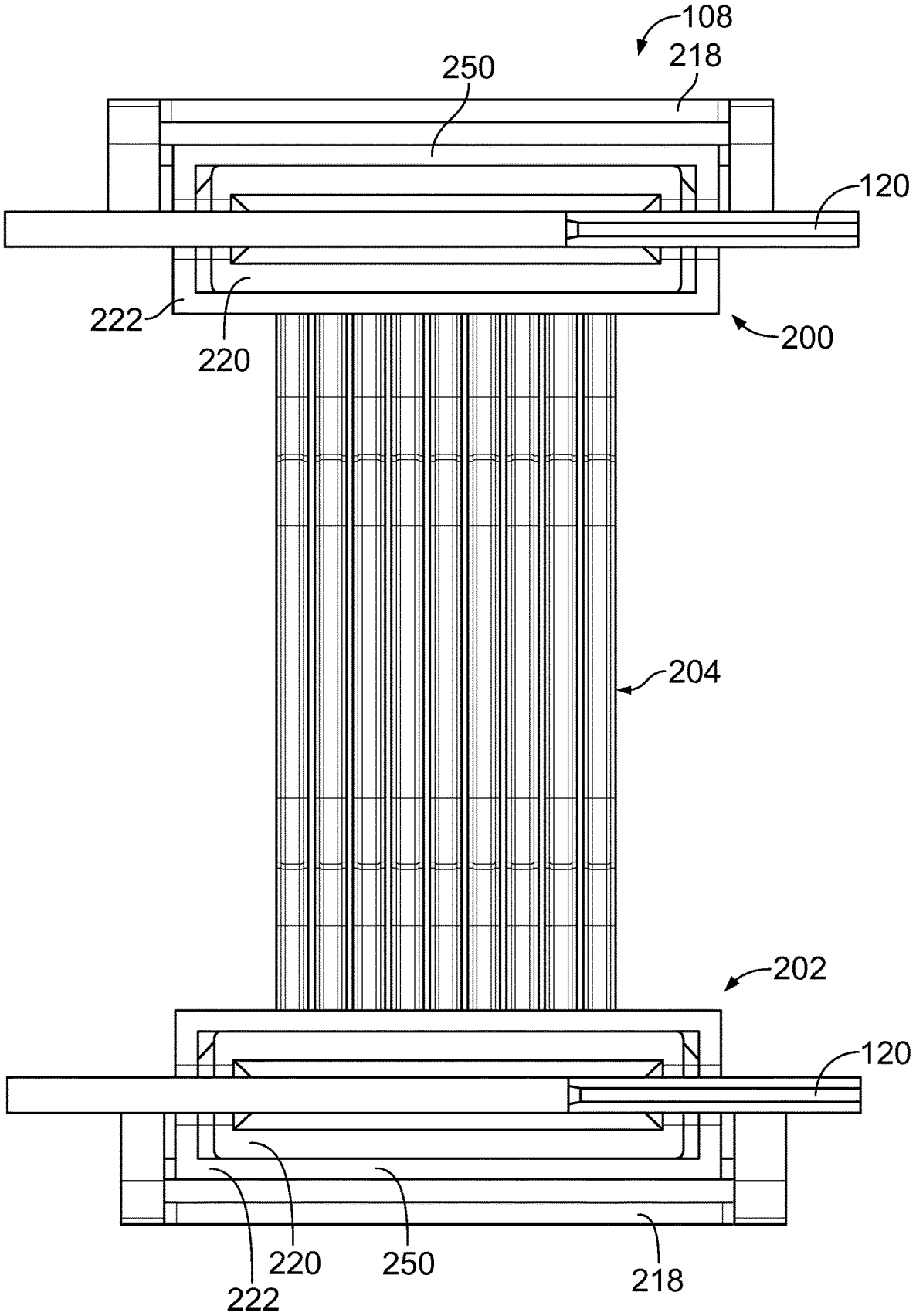
FIG. 7 is a front view of the board-to-board connector assembly in accordance with an exemplary embodiment.

FIG. 7 is a front view of the board-to-board connector assembly 108 in accordance with an exemplary embodiment. FIG. 7 shows the first connector assembly 200 coupled to the first add-in card 120 and the second connector assembly 202 coupled to the second add-in card 120. The connector interposer 204 extends between the first and second connector assemblies 200, 202.

In an exemplary embodiment, the outer shells 222 of the first and second connector assemblies 200, 202 face in opposite directions. For example, the first end 250 of the outer shell 222 of the first connector assembly 200 faces upward and the first end 250 of the outer shell 222 of the second connector 202 faces downward. The latches 218 are located on opposite sides of the add-in cards 120. In an exemplary embodiment, the connector bodies 220 of the first and second connector assemblies 200, 202 have the same orientations as each other, which may result in easier routing of the wires between connectors as opposed to inverting the connectors relative to each other. To achieve the connector bodies 220 having same orientations and the outer shells 222 having opposite orientations, the connector bodies 220 have different orientations in the outer shells 222. The outer shells 222 are able to receive the connector bodies 220 in the different, opposite orientations (for example, both right-side up and upside down). The right side of the connector body 220 faces and engages the first side of the outer shell 222 of the first connector assembly 200 (right-side orientation), whereas the left side of the connector body 220 faces and engages the first side of the outer shell 222 of the second connector assembly 202 (left-side orientation).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A board-to-board connector assembly comprising:

a first connector assembly having a first outer shell and a first connector received in a first cavity of the first outer shell, the first connector having a first connector body holding first contacts, the first connector body having a first card slot receiving a circuit card edge of a first add-in card, the first contacts being arranged at the first card slot for direct connection with circuit pads of the first add-in card at the circuit card edge of the first add-in card, the first outer shell having a perimeter defined between a first side wall and a second side wall opposite the first side wall, the first outer shell having a first outer board guide within the perimeter of the first outer shell configured to engage the first add-in card and guide mating of the first outer shell with the first add-in card, the first outer shell having a first latch extending from the first side wall and located outside of the perimeter, the first latch configured to latchably engage the first add-in card to secure the first connector to the first add-in card;

a second connector assembly having a second outer shell and a second connector received in a second cavity of the second outer shell, the second connector having a second connector body holding second contacts, the second connector body having a second card slot receiving a circuit card edge of a second add-in card, the second contacts being arranged at the second card slot for direct connection with circuit pads of the second add-in card at the circuit card edge of the second add-in card, the second outer shell having a perimeter defined between a first side wall and a second side wall opposite the first side wall, the second outer shell having a second outer board guide within the perimeter of the second outer shell configured to engage the second add-in card and guide mating of the second outer shell with the second add-in card, the second outer shell having a second latch extending from the second side wall and located outside of the perimeter, the second latch configured to latchably engage the second add-in card to secure the second connector to the second add-in card; and a connector interposer between the first connector and the second connector to electrically interconnect the first contacts and the second contacts, the connector interposer configured to electrically connect the first add-in card and the second add-in card.

2. The board-to-board connector assembly of claim 1, wherein the first connector is mounted directly to the first add-in card at the circuit card edge of the first add-in card and the second connector is mounted directly to the second add-in card at the circuit card edge of the second add-in card.

3. The board-to-board connector assembly of claim 1, wherein the first outer board guide includes a support shelf configured to directly engage the first add-in card to support the first outer shell on the first add-in card and wherein the second outer board guide includes a support shelf configured to directly engage the second add-in card to support the second outer shell on the second add-in card.

4. The board-to-board connector assembly of claim 1, wherein the first connector body includes a first inner board guide aligned with the first outer board guide to cooperatively engage the first add-in card to support the first connector assembly on the first add-in card and wherein the second connector body includes a second inner board guide aligned with the second outer board guide to cooperatively engage the second add-in card to support the second connector assembly on the second add-in card.

5. The board-to-board connector assembly of claim 4, wherein the first outer board guide is a channel formed in the first outer shell and the first inner board guide is a channel formed in the first connector body, and wherein the second outer board guide is a channel formed in the second outer shell and the second inner board guide is a channel formed in the second connector body.

6. The board-to-board connector assembly of claim 1, wherein the first connector body includes a right-side inner board guide at a right side of the first connector body and a left-side inner board guide at a left side of the first connector body, the first connector body being selectively positionable in the first outer shell in a right-side orientation and a left-side orientation, the right-side inner board guide being aligned with the first outer board guide in the right-side orientation to cooperatively engage the first add-in card, the left-side inner board guide being aligned with the first outer board guide in the left-side orientation to cooperatively engage the first add-in card, and wherein the second connector body includes a right-side inner board guide at a right side of the second connector body and a left-side inner board guide at a left side of the second connector body, the second connector body being selectively positionable in the second outer shell in a right-side orientation and a left-side orientation, the right-side inner board guide being aligned with the second outer board guide in the right-side orientation to cooperatively engage the second add-in card, the left-side inner board guide being aligned with the second outer board guide in the left-side orientation to cooperatively engage the second add-in card.

7. The board-to-board connector assembly of claim 1, wherein the first connector body includes a side wall configured to be received in a channel in the first add-in card defining the circuit card edge of the first add-in card and wherein the second connector body includes a side wall configured to be received in a channel in the second add-in card defining the circuit card edge of the second add-in card.

8. The board-to-board connector assembly of claim 1, wherein the first latch includes latch arms at opposite sides of the first outer shell and a connecting beam between the latch arms, the latch arms including latching tabs configured to be received in pockets in the first add-in card to latchably couple the latch arms to the first add-in card, the connecting beam being actuated to rotate the latch arms and unlatch the latching tabs from the first add-in card, and wherein the second latch includes latch arms at opposite sides of the second outer shell and a connecting beam between the latch arms, the latch arms including latching tabs configured to be received in pockets in the second add-in card to latchably couple the latch arms to the second add-in card, the connecting beam being actuated to rotate the latch arms and unlatch the latching tabs from the second add-in card.

9. The board-to-board connector assembly of claim 1, wherein the first connector assembly includes a rear housing received in the first cavity and coupled to the first outer shell to retain the first connector in the first cavity, and wherein the second connector assembly includes a rear housing received in the second cavity and coupled to the second outer shell to retain the second connector in the second cavity.

10. The board-to-board connector assembly of claim 1, wherein the first latch is integral with the first outer shell, the second latch is integral with the second outer shell.

11. The board-to-board connector assembly of claim 1, wherein the connector interposer includes a flexible circuit between the first contacts and the second contacts.

12. The board-to-board connector assembly of claim 1, wherein the connector interposer is terminated directly to the first contacts and terminated directly to the second contacts.

13. The board-to-board connector assembly of claim 1, wherein the first connector includes a first interposer end, the connector interposer extending from the first interposer end, the second connector includes a second interposer end, the connector interposer extending from the second interposer end, the first outer shell including a top and a bottom, the first latch extending along the top of the first outer shell, the first interposer end extending along the bottom of the first outer shell, the second outer shell including a top and a bottom, the second latch extending along the bottom of the second outer shell, the second interposer end extending along the top of the second outer shell.

14. An add-in card assembly for a communication system having a host circuit board, the add-in card assembly comprising:

an add-in card having a primary circuit at a primary circuit card edge configured to be plugged into a primary card edge connector of the host circuit board of the communication system, the add-in card having an electronic component electrically connected to the primary circuit, the add-in card having a secondary circuit electrically connected to the electronic component and routed to a secondary circuit card edge; and a board-to-board connector assembly coupled to the secondary circuit at the secondary circuit card edge, the board-to-board connector assembly having a first connector assembly having a first outer shell and a first connector received in a first cavity of the first outer shell, the first connector having a first connector body holding first contacts, the first connector body having a first card slot receiving the secondary circuit card edge, the first contacts being arranged at the first card slot for direct connection with the secondary circuit of the add-in card, the first outer shell having a perimeter defined between a first side wall and a second side wall opposite the first side wall, the first outer shell having a first outer board guide within the perimeter of the first outer shell configured to engage the add-in card and guide mating of the first outer shell with the add-in card, the first outer shell having a first latch extending from the first side wall and located outside of the perimeter, the first latch configured to latchably engage the add-in card to secure the first connector to the add-in card.

15. The add-in card assembly of claim 14, wherein the board-to-board connector includes a connector interposer electrically connected to the first contacts, the connector interposer being electrically connected to second contacts of a second board-to-board connector configured to be mated to a second add-in card.

16. The add-in card assembly of claim 14, wherein the first outer shell positions the first connector within the first cavity relative to the first outer board guide, the first outer shell being mounted directly to the add-in card to align the secondary circuit card edge of the add-in card with the first card slot.

17. The add-in card assembly of claim 14, wherein the add-in card includes channels on opposite sides of the secondary circuit card edge and flanking portions flanking the secondary circuit card edge outside of the channels, the channels receiving sides of the first connector to position the secondary circuit card edge in the first card slot, the first outer board guide engaging the flanking portions to align the secondary circuit card edge of the add-in card with the first card slot.

18. The add-in card assembly of claim 14, wherein the first connector body includes a first inner board guide aligned with the first outer board guide to cooperatively receive the add-in card to support the first connector assembly on the add-in card.

19. The add-in card assembly of claim 14, wherein the first latch includes latch arms at opposite sides of the first outer shell and a connecting beam between the latch arms, the latch arms including latching tabs configured to be received in pockets in the add-in card to latchably couple the latch arms to the add-in card, the connecting beam being actuated to rotate the latch arms and unlatch the latching tabs from the add-in card.

20. A communication system comprising:

a host circuit board having a first card edge connector coupled to the host circuit board and a second card edge connector coupled to the host circuit board;

a first add-in card coupled to the first card edge connector, the first add-in connector having a first circuit card edge, a second add-in card coupled to the second card edge connector, the second add-in connector having a second circuit card edge; and a board-to-board connector assembly coupled to the first add-in card at the first circuit card edge and coupled to the second add-in card at the second circuit card edge to electrically connect the first and second add-in cards, the board-to-board connector assembly comprising:

a first connector assembly having a first outer shell and a first connector received in a first cavity of the first outer shell, the first connector having a first connector body holding first contacts, the first connector body having a first card slot receiving a circuit card edge of a first add-in card, the first contacts being arranged at the first card slot for direct connection with circuit pads of the first add-in card at the circuit card edge of the first add-in card, the first outer shell having a perimeter defined between a first side wall and a second side wall opposite the first side wall, the first outer shell having a first outer board guide within the perimeter of the first outer shell configured to engage the first add-in card and guide mating of the first outer shell with the first add-in card, the first outer shell having a first latch extending from the first side wall and located outside of the perimeter, the first latch configured to latchably engage the first add-in card to secure the first connector to the first add-in card;

a second connector assembly having a second outer shell and a second connector received in a second cavity of the second outer shell, the second connector having a second connector body holding second contacts, the second connector body having a second card slot receiving a circuit card edge of a second add-in card, the second contacts being arranged at the second card slot for direct connection with circuit pads of the second add-in card at the circuit card edge of the second add-in card, the second outer shell having a perimeter defined between a first side wall and a second side wall opposite the first side wall, the second outer shell having a second outer board guide within the perimeter of the second outer shell configured to engage the second add-in card and guide mating of the second outer shell with the second add-in card, the second outer shell having a second latch extending from the second side wall and located outside of the perimeter, the second latch configured to latchably engage the second add-in card to secure the second connector to the second add-in card; and a connector interposer between the first connector and the second connector to electrically interconnect the first contacts and the second contacts, the connector interposer configured to electrically connect the first add-in card and the second add-in card.

* * * * *